United States Patent [19]

Dziedzic et al.

[11] 4,279,297

[45] Jul. 21, 1981

[54] HOUSING FOR CERAMIC HEAT RECUPERATORS AND ASSEMBLY

[75] Inventors: Chester J. Dziedzic, Signal Mountain, Tenn.; Joseph J. Cleveland, Dushore; Ray L. Newman, Towanda, both of Pa.

[73] Assignee: GTE Products Corporation, Stamford, Conn.

[21] Appl. No.: 951,438

[22] Filed: Oct. 16, 1978

[51] Int. Cl.[3] ..... F28D 7/02; F28F 3/00

[52] U.S. Cl. ..... 165/165; 165/166

[58] Field of Search ..... 165/165, 10, 166, 167

[56] References Cited

U.S. PATENT DOCUMENTS

| | | | |
|---|---|---|---|
| 3,889,744 | 6/1975 | Hill et al. | 165/165 |
| 4,083,400 | 4/1978 | Dziedzic et al. | 165/165 |
| 4,168,737 | 9/1979 | Yashimitsu | 165/165 |

*Primary Examiner*—Alfred E. Smith
*Assistant Examiner*—Janice A. Howell

[57] ABSTRACT

Cross-flow ceramic recuperators are useful in industrial waste heat recovery in an assembly in which the ceramic recuperator is held by a metallic housing adapted for retrofitting to the metallic fittings of existing furnaces, ovens and preheaters. The housing is characterized by two pairs of opposing apertured plates held against the inlet and outlet faces of the ceramic recuperator by spring biased through-bolts.

8 Claims, 5 Drawing Figures

HOUSING FOR CERAMIC HEAT RECUPERATORS AND ASSEMBLY

BACKGROUND OF THE INVENTION

This invention relates to housings for industrial heat recuperators, and more particularly relates to a heat recuperator assembly employing a ceramic cross-flow heat recuperator for use on furnaces, ovens and preheaters in an improved housing.

Recent concern about energy conservation and rising fuel costs has caused renewed interest in industrial recuperators to recover waste heat losses and preheat incoming combustion air to increase the efficiency of furnaces, ovens, and preheaters.

While such recuperators are usually constructed from metal parts, the ceramic recuperator has several advantages over conventional metallic recuperators. For example, ceramics in general have high corrosion resistance, high mechanical strength at elevated temperatures, low thermal expansion coefficients (TEC'S) and good thermal shock resistance, and thus exhibit excellent endurance under thermal cycling; are light in weight (about ⅓ the weight of stainless steel); and are cost competitive with high temperature alloys.

Furthermore, ceramic recuperators are available in a variety of shapes, sizes, hydraulic diameters, (hydraulic diameter is a measure of cross-sectional area divided by wetted perimeter) and compositions. Because their TEC'S are typically lower than those of most metals and alloys, however, ceramic recuperators present a compatability problem to the design engineer desiring to incorporate them into existing furnace, oven and preheater structures.

In U.S. Pat. No. 4,083,400, issued Apr. 11, 1978 and assigned to the present assignee, a ceramic cross-flow recuperator core is incorporated into a metallic housing adapted for retrofitting to the metallic fittings of existing furnaces, ovens and preheaters. Insulating and resilient sealing layers between the core and housing minimize heat loss through the metallic housing and prevent leakage of heat transfer fluids, such as exhaust flue gasses and incoming combustion air, past the core.

Experience to date has shown that it is difficult to fabricate a unitary housing to the close tolerances needed to maintain a leak-free seal between the ceramic recuperator core and the housing. In addition, such unitary housings cannot be adjusted in size to accomodate different thermal expansions of the metal and ceramic in changing thermal environments.

SUMMARY OF THE INVENTION

In accordance with the invention, a housing for a ceramic cross flow recuperator comprises two pairs of opposing apertured plates with means for maintaining the plates in firm contact with the inlet and outlet faces of the ceramic recuperator. These plates, as well as the ceramic faces, may easily be machined to close-tolerance flat surfaces for optimum sealing contact, thus enabling minimization of gas leakage past the ceramic-metal seal.

In a preferred embodiment, the means for maintaining contact are elongated through-bolts. In addition, the through-bolts may be biased, such as by helically coiled springs, to maintain such contact between the metal plates and the ceramic faces during severe temperature excursions.

Metal conduits extend the apertures a short distance from the plates, surfaces opposite the contact surfaces, and are adapted for connection to heat transfer fluid conduits.

The recuperator assembly is thus useful, for example, to preheat incoming heating or combustion air and/or fuel and thus increase the efficiency of existing furnaces, ovens and preheaters of varying types and sizes.

DETAILED DESCRIPTION OF THE INVENTION

For a better understanding of the present invention, together with other and further objects, advantages, and capabilities thereof, reference is made to the following disclosure and appended claims in connection with the above-described drawings.

Figure 1:
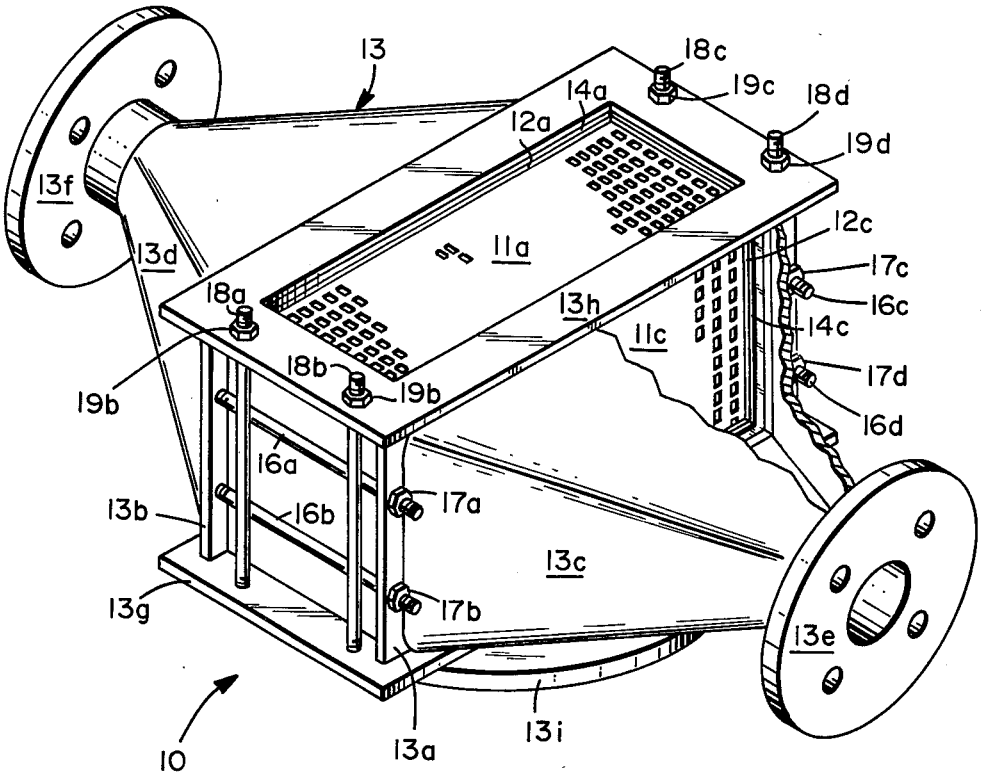
FIG. 1 is a perspective view, partly cut away, of one embodiment of the heat recuperative apparatus of the invention, wherein the ceramic recuperator housing is assembled.

Referring now to FIG. 1 of the drawing, there is shown in perspective, partly cut away, one embodiment of the recuperator assembly 10 of the invention, comprising a central core 11 of a ceramic cross-flow recuperator. Such a structure in which stacked ribbed sheets are comprised of sections sealed along the abutting edges thereof is claimed in copending U.S. patent application Ser. No. 726,950, allowed Dec. 8, 1977, now U.S. Pat. No. 4,130,160, and assigned to the present assignee. The following table lists some exemplary ceramic materials suitable for the fabrication of ceramic recuperators, together with average thermal expansion coefficient (TEC) values over the range from room temperature to 800° C. in inches/inch°C. and maximum use temperatures (MUT) in °F.

TABLE I

| MATERIAL | (INCHES/INCH °C.) TEC | MUT. |
|---|---|---|
| Mullite | $4 \text{ to } 5 \times 10^{-6}$ | 2800° F. |
| Zircon | $4 \text{ to } 5 \times 10^{-6}$ | 2600° F. |
| Magnesium Aluminum Silicate | $1 \times 10^{-6}$ | 2400° F. |
| Porcelain | $4 \times 10^{-6}$ | 2000° F. |
| Aluminum Oxide | $8 \times 10^{-6}$ | 3000° F. |
| $Si_3N_4$ | $2.9 \times 10^{-6}$ | 2500° F. |

In FIG. 1, thin layers of a ceramic material 12, preferably of a compressible structure, such as mullite paper about ⅛ inch thick, and having apertures in their central portions, are cemented to the two pairs of opposing faces of the ceramic recuperator defining cell openings. Layers 12*a* and 12*c* are shown cemented to one face of each pair, 11*a*, and 11*c*, respectively. By this expedient, the central or core portion of the structure is surrounded by sealed cells containing dead air. Thus, a highly efficient insulating housing is provided with a minimal use of material and without the need for fabrication of complex parts. In addition, the compressible mullite 12 acts as a high temperature gasket material during later assembly into the metallic housing 13. Any compatible ceramic cement may be used, such as mullite or aluminum oxide powder and binding agent mixed with water.

Because of the large differences in thermal expansion coefficients between most ceramics and metals, a low temperature gasket, such as a silicone rubber material 14, is located between the ceramic paper 12 and the contact faces of the metallic housing 13 in order to form a good seal in the case of metal warping. Gaskets 14*a* and 14*c* are shown contacting paper 12*a* and 12*c*.

The metallic housing 13 may be formed from castings, or from machined and welded parts, and is preferably of a corrosion resistant metal such as stainless steel in corrosive applications and above 600° F. housing skin temperature. Plate portions 13*a* and 13*b* define apertures terminating in tapered conduit portions 13*c* and 13*d* having flanged portions 13*e* and 13*f* for connection to the incoming heating or combustion air or fuel line. Plate portions 13*g* and 13*h* define apertures 13*g* terminating in flanged portion 13*i* for connection to the exhaust heat or flue gas outlet. The recuperator core is thus heated by the passage of hot exhaust gases through alternate layers of it, and incoming cold air or fuel is in turn preheated as it passed through alternate layers of the core in the transverse direction.

Plate portions 13*a* and 13*b* are held in firm contact with ceramic recuperator faces 11*c* and 11*d* (not shown) by bolts 16*a*, 16*b*, 16*c* and 16*d* and nuts 17*a*, 17*b*, 17*c* and 17*d*, while plate portions 13*g* and 13*h* are held by bolts 18*a*, 18*b*, 18*c* and 18*d* and nuts 19*a*, 19*b*, 19*c* and 19*d*. After placement of the structure in the housing, a ceramic insert (not shown) preferably cast in situ, may be positioned to protrude beyond the opening and contact the mating surface of a ceramic lining of an exhaust or flue gas opening or conduit. Flange 13*i* connects to the flue gas conduit or furnace housing and maintains the ceramic members in intimate contact. Plate 13*h* may serve also as a flange for connection to the flue gas conduit.

Suitable materials for formation of the cast ceramic insert are castable compositions of the materials which are shown in Table II, along with their average thermal expansion coefficients (TEC'S) in inches/inch°C. measured over the range from room temperature to 800° C., and maximum use temperatures (MUT) in °F.

TABLE II

| MATERIAL | TEC | MUT |
|---|---|---|
| Aluminum Oxide | $8 \times 10^{-6}$ | 3000° F. |
| Zircon | 4 to $5 \times 10^{-6}$ | 3000° F. |
| Mullite | 4 to $5 \times 10^{-6}$ | 3300° F. |
| Zirconia | 9 to $10 \times 10^{-6}$ | 4000° F. |

Figure 2:
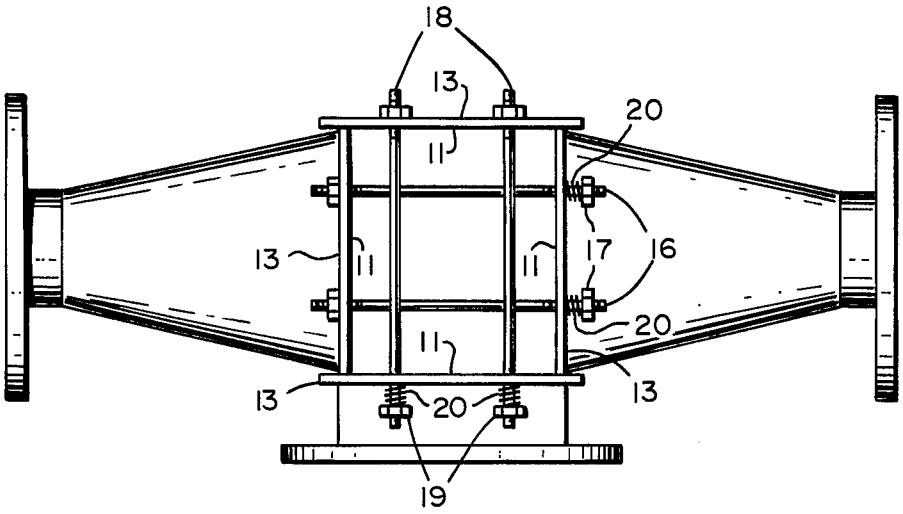
FIG. 2 is a front elevational view, of the assembly.

Referring now to FIG. 2 there is shown a front elevational view, partly in section, of the assembly of FIG. 1 wherein bolts 16 and 18 and nuts 17 and 19 are provided with helical springs 20 which act as bias elements permitting expansion and contraction of the bolts during thermal cycling, while maintaining intimate contact between the plate portions 13 and ceramic faces 11.

In one assembly of the invention installed on a test kiln furnace operated under conditions to result in a back pressure of 20" $H_2O$ on the cold air face of the recuperator, leakage was measured by measuring air flow on cold & hot air side of the recuperator and found to be about 14 percent as compared with 22 percent when employing the unitary housing described in the Prior Art, all other conditions being unchanged.

Figure 3:
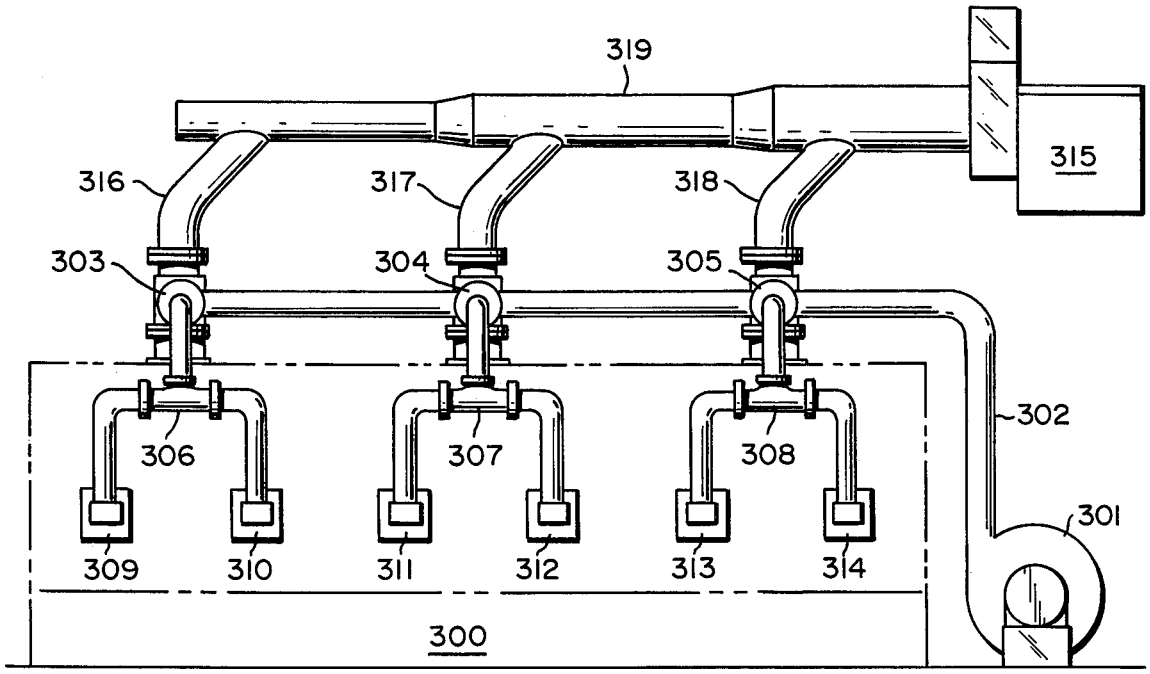
FIG. 3 is a side elevational view of a heat recuperative system employing a series of recuperator assemblies of the invention on a tunnel-type furnace.

Referring now to FIG. 3, there is shown in side elevational view an arrangement wherein a series of three recuperators of the invention are installed on a tunnel kiln 300 employing six gas burners. Blower 301 supplies combustion air through conduit 302 to recuperators 303, 304, and 305, and thence the preheated air is delivered through conduits 306, 307 and 308 to gas burners 309, 310, 311, 312, 313 and 314. Flue gas combustion products are drawn by blower 315 through recuperators 303, 304, and 305, and thence through ducts 316, 317 and 318 to flue gas exhaust manifold 319.

Figure 4:
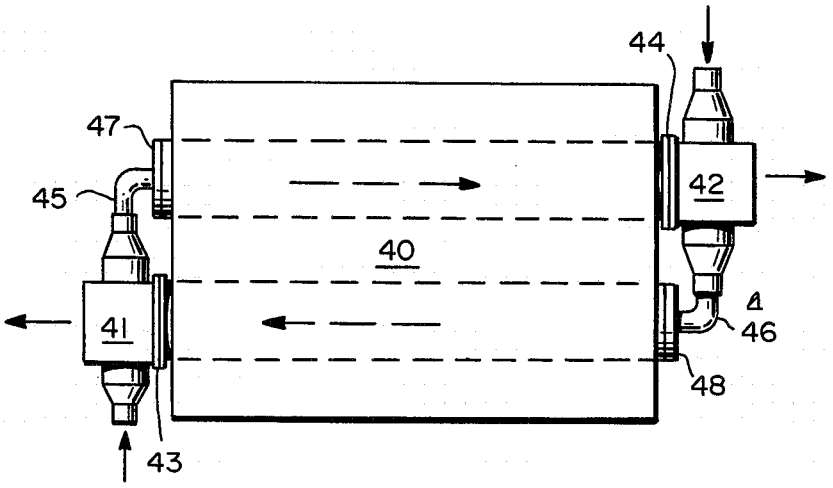
FIG. 4 is a schematic diagram of a heat recuperative system employing two recuperator assemblies of the invention on a two-burner horizontal radiant tube furnace.
Figure 5:
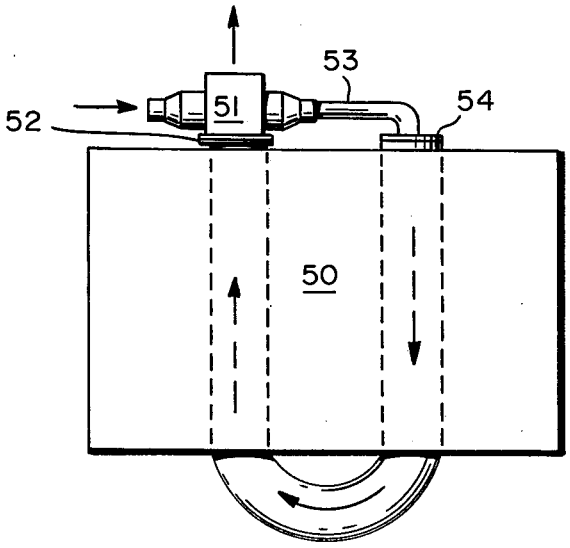
FIG. 5 is a schematic diagram of a similar system for a single-burner vertical "U" radiant tube furnace.

Referring now to FIG. 4, there is shown in schematic form an arrangement whereby recuperators 41 and 42 are installed on the exhaust ports 43 and 44 a two-burner horizontal radiant tube furnace 40. Preheated combustion air is supplied through conduits 45 and 46 to burner inlets 47 and 48. FIG. 5 shows a similar arrangement for a vertical "U" radiant tube furnace 50 employing a single burner. Recuperator 51 is installed on the exhaust port 52 and preheated combustion air is supplied through conduit 53 to burner inlet 54.

While there has been shown and described what are at present considered the preferred embodiments of the invention, it will be obvious to those skilled in the art that various changes and modifications may be made therein without departing from the scope of the invention as defined by the appended claims.

What is claimed is:

1. A heat recuperator assembly comprising:

(a) a core of a cross-flow ceramic recuperator, having first and second pairs of opposing faces defining cell openings for the passage of first and second heat transfer fluids, respectively, in directions transverse to one another, the first fluid transferring heat to the second fluid during passage through the cells, whereby each pair of faces has in operation a hot face and a cold face, the hot face of the first pair being the inlet face for the first fluid, and the hot face of the second pair being the outlet face for the second fluid, and (b) a metallic housing surrounding the core, the housing defining openings communicating with the core cell openings, the housing openings adapted for coupling to external fluid conduits, characterized in that the housing comprises (1) two pairs of opposing plates having opposing inner faces for contact with the hot and cold faces of the core, (2) conduit means extending from the outer faces of the plates, (3) means for coupling the conduit means to external fluids conduits, and (4) means for holding the inner faces in contact with the core faces, said means comprising two sets of elongated bolts and nuts, the bolts of each set extending between opposing pairs of plates, and said means further comprising means to bias the plates in an inward direction against the ceramic recuperator.

2. The assembly of claim 1 in which the bias means comprises helical springs.

3. The assembly of claim 1 in which the coupling means comprises flanges.

4. The assembly of claim 1 in which a high temperature sealing means is provided between the ceramic recuperator faces and plate faces.

5. The assembly of claim 4 in which the sealing means comprises mullite paper gaskets.

6. The assembly of claim 1 in which a low temperature sealing means is provided between the ceramic recuperator faces and plate faces.

7. The assembly of claim 6 in which the sealing means comprises silicone rubber gaskets.

8. The assembly of claims 4, 5, 6 or 7 in which the high temperature sealing means is in contact with the ceramic face and the low temperature sealing means is in contact with the plate face and both sealing means are in contact with each other.

* * * * *